US007215183B2

(12) United States Patent
Nakada

(10) Patent No.: US 7,215,183 B2
(45) Date of Patent: May 8, 2007

(54) REFERENCE VOLTAGE GENERATOR CIRCUIT

(75) Inventor: Akira Nakada, Nagano (JP)

(73) Assignee: Seiko Epson Corporation (JP)

( * ) Notice: Subject to any disclaimer, the term of this patent is extended or adjusted under 35 U.S.C. 154(b) by 9 days.

(21) Appl. No.: 11/174,927

(22) Filed: Jul. 5, 2005

(65) Prior Publication Data

US 2006/0006927 A1 Jan. 12, 2006

(30) Foreign Application Priority Data

Jul. 7, 2004 (JP) ..... 2004-200560

(51) Int. Cl.
*G05F 1/10* (2006.01)

(52) U.S. Cl. ..... 327/539; 327/143

(58) Field of Classification Search ..... 323/313, 323/314; 327/143, 198, 535, 537, 539
See application file for complete search history.

(56) References Cited

U.S. PATENT DOCUMENTS 6,018,235 A * 1/2000 Mikuni ..... 323/313
6,346,849 B1 * 2/2002 Pioppo ..... 327/539
6,356,064 B1 * 3/2002 Tonda ..... 323/313
6,724,176 B1 * 4/2004 Wong et al. ..... 323/316
7,042,279 B2 * 5/2006 Tsukuda ..... 327/539
7,071,767 B2 * 7/2006 Ou-yang et al. ..... 327/539

FOREIGN PATENT DOCUMENTS

JP 06-075649 3/1994
JP 08-016266 1/1996
JP 10-171545 6/1998

OTHER PUBLICATIONS

M. Waltari, et al., "Reference Voltage Driver for Low-Voltage CMOS A/D Converters", Proceedings of ICECS 2000, vol. 1, pp. 28-31 (2000), no month.

* cited by examiner

*Primary Examiner*—Jeffrey Zweizig
(74) *Attorney, Agent, or Firm*—Harness, Dickey & Pierce, P.L.C.

(57) ABSTRACT

A reference voltage generator circuit includes: a band gap circuit that outputs a predetermined voltage to an output terminal; a plurality of current mirror circuits, a gate electrode of at least one of which being coupled with one current path, and a gate electrode of at least another one of which being coupled with an other current path, and which are further coupled with the band gap circuit so as to supply an output current to the output terminal corresponding to a current flowing in either the one or the other current path; and a control unit that detects an output voltage of the output terminal of the band gap circuit and that controls a current flowing in at least the one or the other current path corresponding to the detected output voltage.

2 Claims, 4 Drawing Sheets

REFERENCE VOLTAGE GENERATOR CIRCUIT

RELATED APPLICATIONS

This application claims priority to Japanese Patent Application No. 2004-200560 filed Jul. 7, 2004 which is hereby expressly incorporated by reference herein in its entirety.

BACKGROUND

1. Technical Field

The present invention relates to a reference voltage generator circuit, particularly a reference voltage generator circuit including a band gap circuit.

2. Related Art

A band gap circuit has been used widely various kinds of semiconductor circuits. The band gap circuit is capable of generating voltage with extremely small temperature reliance by taking advantage of a difference in voltage-current characteristics created when two diodes different in size are coupled.

However, the band gap circuit essentially has two stable output voltage points, namely, a normal operating point and a stopping point. If the output voltage becomes stabilized at the stopping point, it is possible that the band gap circuit does not start.

On this account, there is a band gap-based reference voltage generator circuit having a startup circuit so as to bring the output voltage back to one at the normal operating point. The startup circuit is a circuit that brings the output voltage of the band gap circuit back to the normal operating point by forcefully supplying a starting current to the band gap circuit in order to prevent the output voltage from reaching to the stopping point (e.g., see M. Waltari, K. Halonen, "Reference Voltage Driver for Low-Voltage CMOS A/D Converters," Proceedings of ICECS 2000, Vol. 1, pp. 28–31, 2000).

FIG. 4 shows an example of a conventional band gap-based reference voltage generator circuit. As shown in FIG. 4, the band gap-based reference voltage generator circuit is a band gap circuit 101 with a startup circuit 102 added thereto. The startup circuit 102 monitors an output voltage OUT at an output terminal of the band gap circuit 101, and, when the output voltage OUT is the voltage at the normal operating point, a transistor 111 turns on while transistors 112 and 113 stay off. In contrast, when the output voltage OUT is at the stopping point, the transistor 111 turns off while the transistors 112 and 113 turn on, and, as a result, transistors 114 and 115 turn on, and, thereby, a predetermined current Ia is supplied to a line 116. With the supply of the predetermined current Ia to the line 116, the output voltage OUT rises and reaches to the normal operating point.

As described, the conventional startup circuit 102 brings back the output voltage OUT from the stopping point to the normal operating point by supplying the current Ia in an amount necessary for the startup to the band gap circuit 101. However, even after the band gap-based reference voltage generator circuit has started, a current Ib keeps flowing to a transistor 117 which is coupled in series with the transistor 111 of the startup circuit 102. It is not desirable that the current Ib continue to flow to the transistor 117 even after the band gap-based reference voltage generator circuit has started when considering reducing electric consumption.

In view of these issues, the present invention aims to provide a reference voltage generator circuit which enables to reduce electric consumption.

SUMMARY

The reference voltage generator circuit of the invention includes: a band gap circuit that outputs a predetermined voltage to an output terminal; a plurality of current mirror circuits, a gate electrode of at least one of which being coupled with one current path, and a gate electrode of at least another one of which being coupled with an other current path, and which are further coupled with the band gap circuit so as to supply an output current to the output terminal corresponding to a current flowing in either the one or the another current path; and a control unit that detects an output voltage of the output terminal of the band gap circuit and that controls a current flowing in at least the one or the other current path corresponding to the detected output voltage.

The reference voltage generator circuit of the invention includes: a band gap circuit that outputs a predetermined voltage to an output terminal and a startup circuit, wherein the startup circuit includes: a plurality of current mirror circuits, a gate electrode of at least one of which being coupled with one current path, and a gate electrode of at least another one of which being coupled with an other current path; and which are further coupled with the band gap circuit so as to supply an output current to the output terminal corresponding to a current flowing in either the one or the other current path; and a control unit that detects an output voltage of the output terminal of the band gap circuit and that controls a current flowing in at least one or the other current path corresponding to the detected output voltage.

With these compositions, it is possible to realize the reference voltage generator circuit that enables to reduce electric consumption.

DETAILED DESCRIPTION

In the following, embodiments of the invention will be described with reference to the accompanying drawings.

First Embodiment

Figure 1:
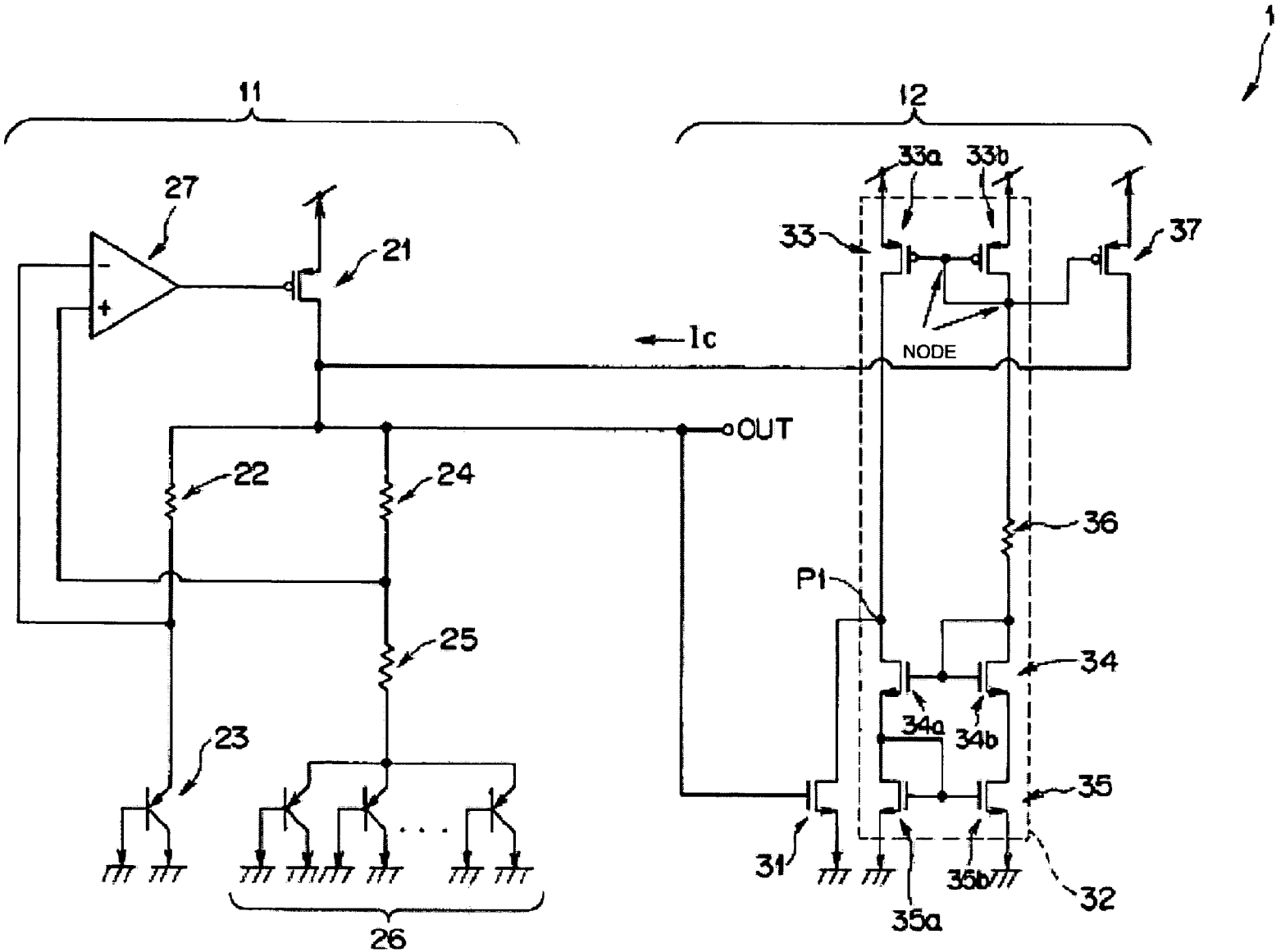
FIG. 1 is a circuit diagram of a reference voltage generator circuit of a first embodiment of the invention.

First, based on FIG. 1, a composition of the reference voltage generator circuit of the present embodiment will be described. FIG. 1 is a circuit diagram of a reference voltage generator circuit 1 of the first embodiment of the invention.

In FIG. 1, a band gap circuit 11 includes: a P-channel MOS transistor 21, resistors 22, 24, and 25, a PNP bipolar transistor 23, and a plurality of PNP bipolar transistors 26. A drain electrode (hereinafter referred to simply as drain) of the transistor 21 is coupled to the emitter of the PNP bipolar transistor 23 via the resistor 22. That is, the transistor 21, the resistor 22, and the transistor 23 are connected in series. Also, the drain of the transistor 21 is coupled commonly with the emitters of the plurality of PNP bipolar transistors 26. In other words, a series circuit composed of the resistor 22 and the transistor 23 and a series circuit composed of the resistors 24 and 25 and the plurality of PNP bipolar transistors 26 are connected in parallel. A connection point of the transistor 22 and the transistor 23 is coupled to an inversing input (−) of a comparator circuit 27 which is an operational amplifier. A connection point of the resistors 24 and 25 is coupled to a non-inverting input (+) of the comparator circuit 27. Additionally, resistance values of the resistors 22 and 24 are the same. An output of the comparator circuit 27 is coupled to a gate electrode (hereinafter referred to simply as gate) of the transistor 21. With this composition, a predetermined output voltage OUT such as 1.2V, for example, is output to the output terminal of the band gap circuit 11 coupled to the drain of the transistor 21.

In contrast, a startup circuit 12 has an N-channel MOS transistor 31 as a control unit, as will be described later, in which the gate of the transistor 31 is coupled to the output terminal of the band gap circuit 11. The startup circuit 12 contains a multistage current mirror circuit 32 consisting of a plurality of current mirror circuits connected in series in multiple stages. FIG. 1 shows a case of three-staged current mirror circuits connected in series. A first stage current mirror circuit 33 is composed of two P-channel MOS transistors 33*a* and 33*b* coupled with and mirroring each other. A second stage current mirror circuit 34 is composed of two N-channel MOS transistors 34*a* and 34*b* coupled with and mirroring each other. A third stage current mirror circuit 35 is composed of two N-channel MOS transistors 35*a* and 35*b* coupled with and mirroring each other. In short, the multistage current mirror circuit 32 includes a plurality of current mirror circuits connected in series.

The source electrode (hereinafter referred to simply as source) of the transistor 33*a* is coupled to a wire that supplies power source voltage (e.g., 3V). The drain of the transistor 33*a* is coupled to the drain of the transistor 34*a*. The source of the transistor 34*a* is coupled to the drain of the transistor 35*a*. The drain of the transistor 34*a* is coupled to the drain of the transistor 31. The gate of the transistor 35*a* is coupled to the source of the transistor 34*a* and the drain of the transistor 35*a*. The source of the transistor 35*a* is coupled to a ground voltage supply wire.

In contrast, the source of the transistor 33*b* is coupled to a power source voltage supply wire. The drain of the transistor 33*b* is coupled to the gate of the transistor 33*a* and the gate of the transistor 33*b* and, further, to the gate of a P-channel MOS transistor 37. The source of the transistor 37 is coupled to a power source voltage supply wire. The drain of the transistor 37 is coupled to the drain of the transistor 21, that is, to the output terminal of the band gap circuit 11. The drain of the transistor 33*b* is coupled to the drain of the transistor 34*b* via a resistor 36. A connection point of the resistor 36 and the drain of the transistor 34*b* is coupled to the gates of the transistors 34*a* and 34*b*. The source of the transistor 34*b* is coupled to the drain of the transistor 35*b*. In other words, the gate and the drain of the transistor 35*a* are electrically coupled to the drains of the transistors 33*a* and 31. The source of the transistor 35*b* is coupled to a ground voltage supply wire.

Thus, the multistage current mirror circuit 32 includes a first current path flowing through the transistors 33*a*, 34*a*, and 35*a* and a second current path flowing through the transistors 33*b*, 34*b*, and 35*b*. The transistor 37 supplies an output voltage corresponding to the current flowing in the second current path to the output terminal of the band gap circuit 11.

Next, operations of the circuit of FIG. 1 will be described.

First, when the power source voltage is applied to the reference voltage generator circuit 1, the transistor 31, which is the control unit, detects the output voltage OUT at the output terminal of the band gap circuit 11. When the output voltage OUT is 0V, that is, at the stopping point, the transistor 31 which is the control unit is turned off. At this point, a power source voltage is being applied to the multistage current mirror circuit 32, and, therefore, a predetermined current is flowing in the two current paths. Consequently, since a current Ic corresponding to the current flowing in these current paths is supplied to the output terminal of the band gap circuit 11 from the transistor 37, a potential of the output voltage OUT rises gradually. As the potential of the output voltage OUT rises to 1.2V, that is, to the normal operating point, the transistor 31 turns on, and, as a result, a potential at a connection point P1 of the transistors 33*a* and 34*a* becomes 0 (zero). When the potential at the connection point P1 becomes 0, the current, of all the currents flowing in the multistage current mirror circuit 32, which flows through the connection point P1 flows more to the transistor 31 than to the transistor 34*a*. Therefore, each transistor inside the multistage current mirror circuit 32 turns off and no current flows to the transistor 37.

As described, when the output voltage OUT is at the stopping point immediately after the power source voltage has been supplied to the reference voltage generator circuit, and as the transistor 31 controls the current flowing in one of the two current paths of the multistage current mirror circuit 32, the startup circuit 12 supplies a predetermined current to the band gap circuit 11 so as to raise the output voltage OUT to the voltage of the normal operating point. Thereafter, when the transistor 31 controls the current flowing in one of the two current paths of the multistage current mirror circuit 32, no current flows in any of the transistors inside the multistage current mirror circuit 32 or in the transistor 37. Therefore, it is possible, as a result, to reduce the electric consumption once the startup circuit 12 starts.

Further, when the voltage of the output voltage OUT is at the normal operating point immediately after the power source voltage has been applied to the reference voltage generator circuit, the transistor 31 is turned on, and the potential at the connection point P1 becomes 0. Therefore, the current, of all the currents flowing in the multistage current mirror circuit 32, which flows through the connection point P1 flows more to the transistor 31 than to the transistor 34*a*. Consequently, each transistor inside the multistage current mirror circuit 32 turns off, and no current flows to the transistor 37.

As thus described, even if the output voltage OUT is at the normal operating point, when the transistor 31 controls the current flowing in one of the two current paths of the multistage current mirror circuit 32, no current flows to any of the transistors inside the multistage current mirror circuit 32 or to the transistor 37, and, as a consequence, it becomes possible to reduce the electric consumption once the startup circuit 12 starts.

As described, with the first embodiment, it is possible to realize the reference voltage generator circuit which enables to reduce electric consumption.

Second Embodiment

Figure 2:
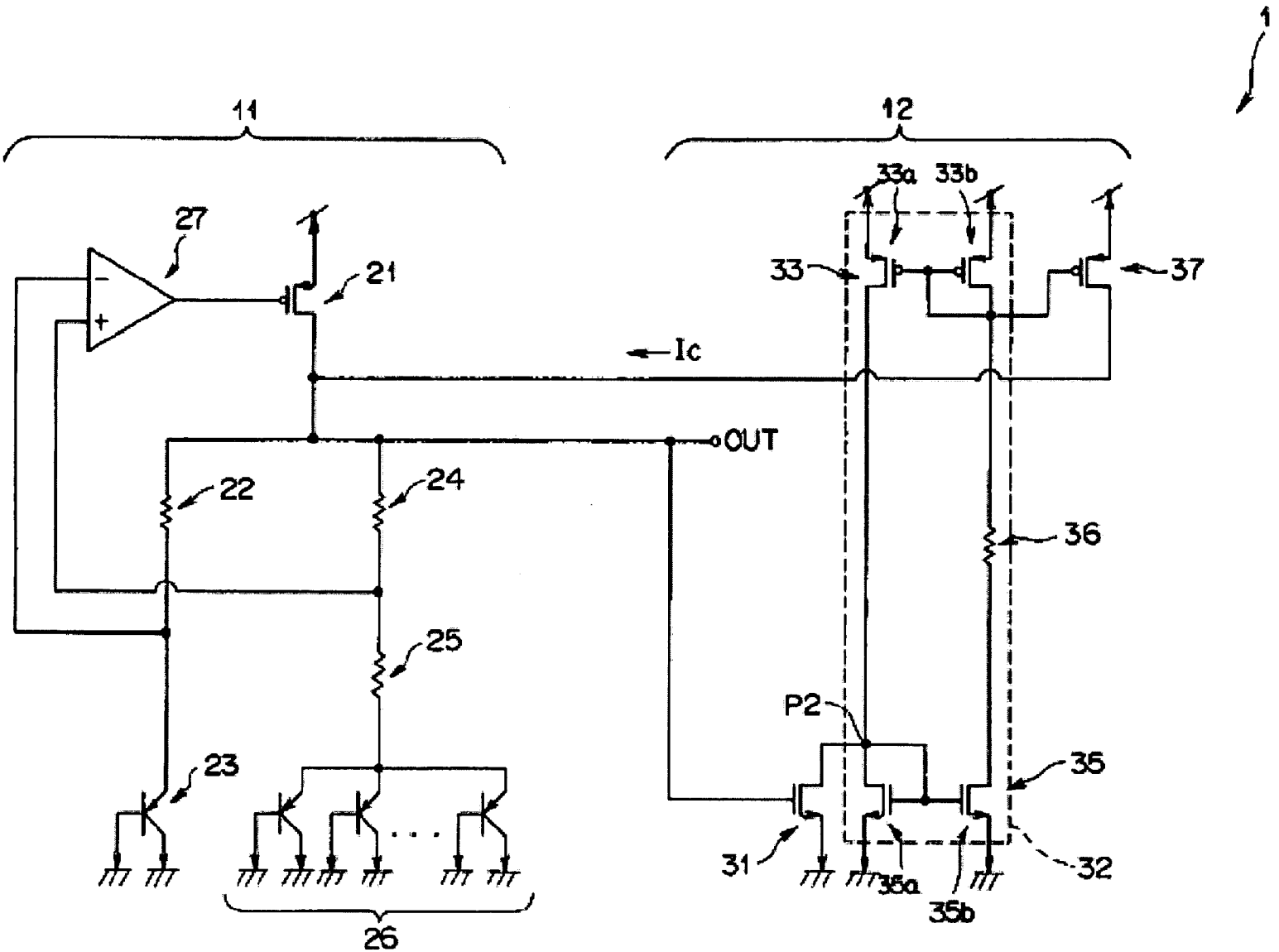
FIG. 2 is a circuit diagram of a reference voltage generator circuit of a second embodiment of the invention.

Next, a composition of the reference voltage generator circuit of the second embodiment will be described. FIG. 2 is a circuit diagram of the reference voltage generator circuit of the second embodiment. The reference voltage generator circuit of the second embodiment differs from the reference voltage generator circuit of the first embodiment in that there are a fewer current mirror circuits in the startup circuit of the second embodiment than those of the first embodiment. The same reference numerals are used here for the same composition elements as those of the first embodiment, and explanations thereof shall be omitted.

As shown in FIG. 2, one difference between the reference voltage generator circuit of the second embodiment and that of the first embodiment is that there is no current mirror circuit 34 in FIG. 2 as is in the multistage current mirror circuit 32 in FIG. 1. However, the rest of the composition elements are identical.

Operations of the circuit of FIG. 2 are approximately the same as those of the circuit of FIG. 1, in that when voltage of the output voltage OUT is at the stopping point, the transistor 31 turns to an off state. Here, because a power source voltage is being applied to the multistage current mirror circuit 32*a*, a predetermined current is flowing therein. Accordingly, because the current Ic is supplied from the transistor 37 to the output terminal of the band gap circuit 11, a potential of the output voltage OUT rises gradually. As the potential of the output voltage OUT rises and reaches to a predetermined voltage, the transistor 31 turns on, and a potential at a connection point P2 of the transistors 33*a* and 35*a* becomes 0 (zero). When the potential at the connection point P2 becomes 0, a current, of all currents flowing in the current mirror circuit 32*a*, which flows through the connection point P2 flows more to the transistor 31 than to the transistor 35*a*. Therefore, the transistors inside the multistage current mirror circuit 32*a* turn off, and, consequently, no current flows to the transistor 37. As a result, it becomes possible to reduce the electric consumption once the startup circuit 12*a* starts.

Further, when the output voltage OUT is at the normal operating point, the transistor 31 turns to an on state quite similarly to the circuit of FIG. 1. Consequently, because the potential at the connection point P2 becomes 0, the current, of all the currents flowing in the current mirror circuit 32*a*, which flows through the connection point P2 flows more to the transistor 31 than to the transistor 35*a*, and, therefore, the transistors inside the current mirror circuit 32*a* turn off. Consequently, because no current flows to the transistor 37, it is possible, as a result, to reduce the electric consumption once the startup circuit 12*a* starts.

As thus described, it is possible with the second embodiment to realize the reference voltage generator circuit which enables to reduce electric consumption.

Third Embodiment

Figure 3:
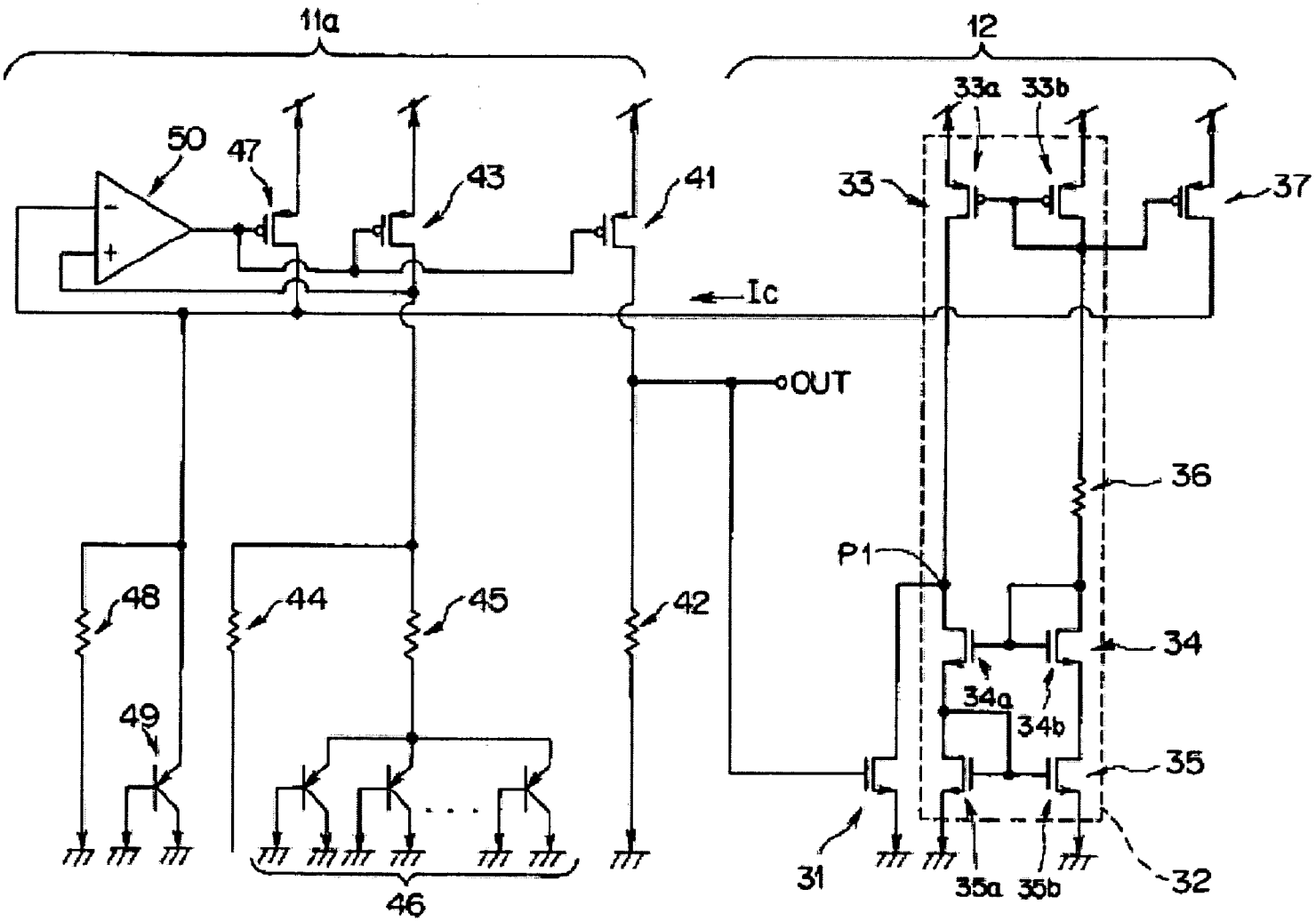
FIG. 3 is a circuit diagram of a reference voltage generator circuit of a third embodiment of the invention.
Figure 4:
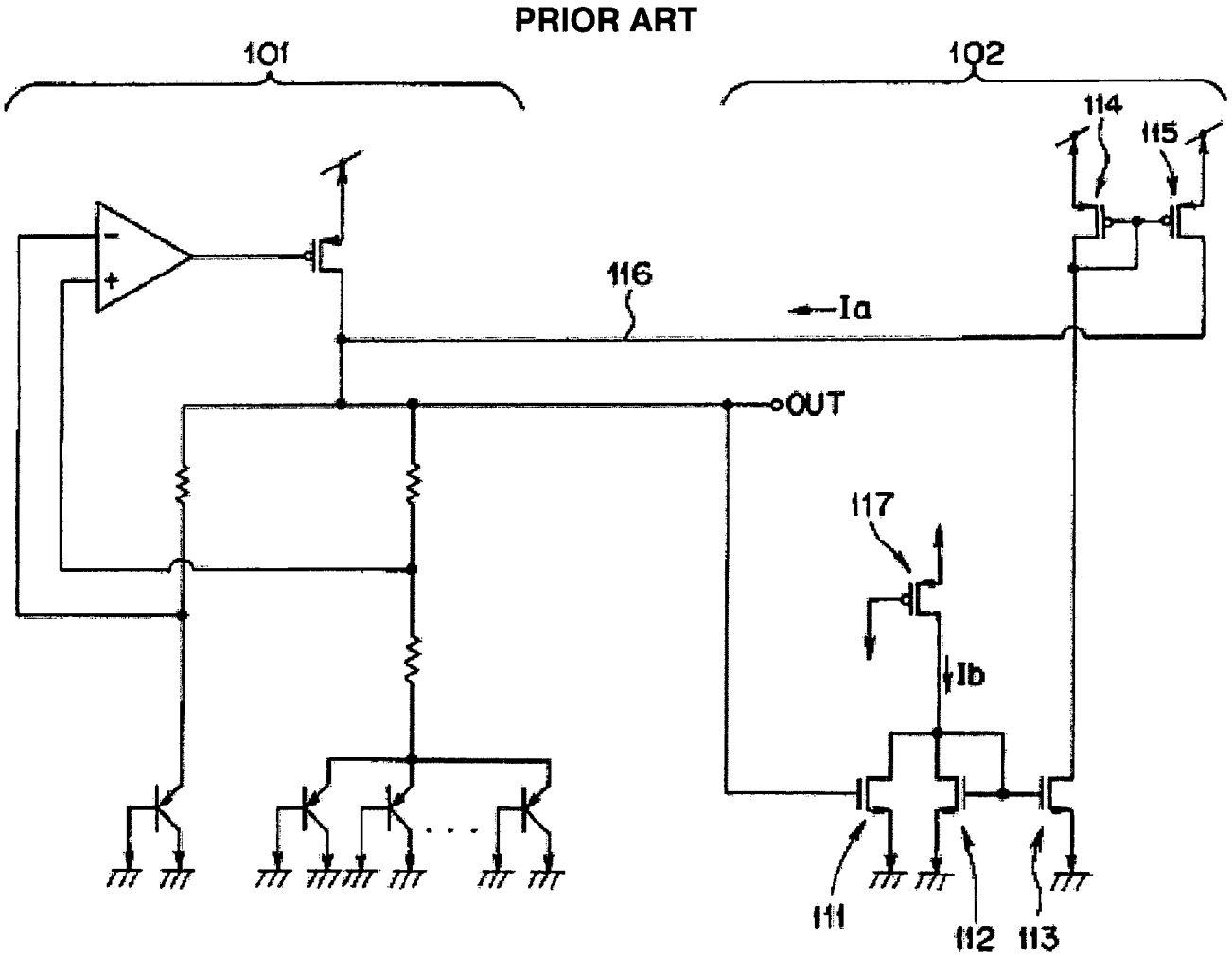
FIG. 4 is a circuit diagram of a conventional band gap-based reference voltage generator circuit.

Next, a composition of the reference voltage generator circuit of the third embodiment will be described. FIG. 3 is a circuit diagram of the reference voltage generator circuit of the third embodiment. The reference voltage generator circuit of the third embodiment has the same startup circuit 12 as that of the first embodiment but differs in the band gap circuit. The same reference numerals are used here for the same composition elements as those of the first embodiment, and explanations thereof shall be omitted.

As shown in FIG. 3, the reference voltage generator circuit of the third embodiment has a band gap circuit different from that in the circuit of FIG. 1. A band gap circuit 11*a* of FIG. 3 is a band gap circuit to be used when the power source voltage is low. With the band gap circuit 11*a*, the power source voltage is as low as 1V, for example, and the output voltage OUT of the output terminal is as low as 0.6V.

The band gap circuit 11*a* includes a series circuit composed of a P-channel MOS transistor 41 and a resistor 42 coupled to the drain of the transistor 41. The drain of the transistor 41 is coupled to one terminal of the resistor 42. The source of the transistor 41 is coupled to a power source voltage supply wire, and the other terminal of the resistor 42 is coupled to a ground potential supply wire. The drain of the transistor 41 is coupled to the output terminal of the band gap circuit 11*a* and to the gate of the transistor 31.

The band gap circuit 11*a* further includes: P-channel MOS transistors 43 and 47, resistors 44, 45, and 48, a PNP bipolar transistor 49, and a plurality of PNP bipolar transistors 46.

The source of the transistor 43 is coupled to a power source voltage supply wire. The drain of the transistor 43 is coupled to a ground potential supply wire via the resistor 44. The drain of the transistor 43 is further coupled commonly to emitters of the plurality of PNP bipolar transistors 46 via the resistor 45. Each base and each collector of the plurality of transistors 46 is coupled to each ground potential supply wire.

The drain of the transistor 47 is coupled to one terminal of resistor 48 and the emitter of the PNP bipolar transistor 49. The source of the transistor 47 is coupled to a power source voltage supply wire. The other terminal of the resistor 48 and the base and collector of the transistor 49 are coupled to ground potential supply wires.

In addition, the band gap circuit 11*a* further includes a comparator circuit 50 which is an operational amplifier. The drain of the transistor 37 of the startup circuit 12 and the drain of the transistor 47 are coupled to the inverting input (−) of the comparator circuit 50, and the drain of the transistor 43 is coupled to the non-inverting input (+) of the comparator circuit 50. The output of the comparator circuit 50 is coupled to the gate of the transistor 47, the gate of the transistor 43, and to the gate of the transistor 41. With this composition, the output voltage OUT of the transistor 41 can be maintained at a fixed voltage.

The composition of the startup circuit 12 is identical to the startup circuit 12 of the first embodiment.

Operations of the circuit of FIG. 3 are approximately the same as those of the circuit of FIG. 1. The only differences are that the transistor 37 supplies an output current via the comparator circuit 50 by controlling the gate of the transistor 41 and that the band gap circuit 11*a* is a band gap circuit whose power source voltage is low.

Accordingly, with the reference voltage generator circuit of the third embodiment, it also is possible to reduce the electric consumption once the startup circuit 12 starts.

With the reference voltage generator circuit of the above-described embodiments of the invention, the electric consumption can be reduced upon starting the startup circuit 12.

The invention is not limited to the embodiments as hereinbefore described, and various alterations and modifications are possible within the gist of the invention.

What is claimed is:

1. A reference voltage generator circuit, comprising:

a band gap circuit that outputs a predetermined voltage to an output terminal;

a plurality of current mirror circuits;

a control unit having a gate directly coupled to the output terminal of the band gap circuit that detects an output voltage of the output terminal of the band gap circuit and that controls a current flowing in at least one or another current path corresponding to the detected output voltage, wherein a gate electrode of at least one of the current mirror circuits is coupled with one current path, a gate electrode of at least another one of the current mirror circuits is coupled with the other current path, and the current mirror circuits are further coupled with the band gap circuit so as to supply an output current to the output terminal corresponding to a current flowing in either the one or the another current; and an output transistor directly coupled to the output terminal of the band gap circuit and that supplies a predetermined voltage to the band gap circuit that corresponds to the current flowing in the other current path when the control unit is turned off.

2. A reference voltage generator circuit, comprising:

a band gap circuit that outputs a predetermined voltage to an output terminal; and a startup circuit;

wherein the startup circuit includes:

a plurality of current mirror circuits, a gate electrode of at least one of the current mirror circuits being coupled with one current path, and a gate electrode of at least another one of which being coupled with another current path, and which are further coupled with the band gap circuit so as to supply an output current to the output terminal corresponding to a current flowing in either the one or the other current path; and a control unit having a gate directly coupled to the output terminal of the band gap circuit that detects an output voltage of the output terminal of the band gap circuit and that controls a current flowing in at least the one or the other current path corresponding to the detected output voltage; and an output transistor directly coupled to the output terminal of the band gap circuit and that supplies a predetermined voltage to the band gap circuit that corresponds to the current flowing in the other current path when the control unit is turned off.

* * * * *